US005748150A

United States Patent [19]

Rudisill

[11] Patent Number: 5,748,150

[45] Date of Patent: May 5, 1998

[54] RETRACTABLE ANTENNA ASSEMBLY

[75] Inventor: Charles Albert Rudisill, Apex, N.C.

[73] Assignee: Ericsson, Inc., Research Triangle Park, N.C.

[21] Appl. No.: 627,448

[22] Filed: Apr. 4, 1996

[51] Int. Cl.[6] ..... H01Q 1/24

[52] U.S. Cl. ..... 343/702; 343/702; 343/889; 343/900

[58] Field of Search ..... 343/702, 888, 343/889, 895, 900, 901, 903; H01Q 1/24

[56] References Cited

U.S. PATENT DOCUMENTS

| | | | |
|---|---|---|---|
| 2,491,629 | 12/1949 | Vernier et al. | 343/901 |
| 3,254,344 | 5/1966 | Rohrs | 343/901 |
| 4,725,845 | 2/1988 | Phillips | 343/702 |
| 4,989,012 | 1/1991 | Martensson et al. | 343/702 |
| 5,168,278 | 12/1992 | Morita | 343/702 |
| 5,204,687 | 4/1993 | Elliott et al. | 343/702 |
| 5,258,772 | 11/1993 | Inanaga et al. | 343/702 |
| 5,353,036 | 10/1994 | Baldry | 343/702 |
| 5,455,595 | 10/1995 | Yokoyama et al. | 343/702 |
| 5,534,878 | 7/1996 | Johnson | 343/702 |

FOREIGN PATENT DOCUMENTS

| | | | |
|---|---|---|---|
| 658022 | 4/1965 | Belgium | 343/903 |
| 0343847 | 11/1989 | European Pat. Off. | H01Q 1/24 |
| 4221707 | 1/1994 | Germany | H01Q 1/10 |

*Primary Examiner*—Donald T. Hajec
*Assistant Examiner*—Tan Ho
*Attorney, Agent, or Firm*—Jenkens & Gilchrist

[57] ABSTRACT

A compression spring, enclosed within a portion of a guide member, provides a bias force to automatically extend an antenna in response to release of the antenna from a retracted position. The portion of the guide member enclosing the spring is nonlinearly aligned with another portion of the guide member that is adapted to receive the antenna when retracted. The retractable antenna assembly solves the awkward requirement for the use of two hands to extend an antenna on portable telecommunication instruments, without increasing the size or significantly adding to the weight of such instruments.

7 Claims, 1 Drawing Sheet

RETRACTABLE ANTENNA ASSEMBLY

This invention relates generally to manually retractable antennas for portable or mobile telecommunication equipment, and more particularly to such antennas that are automatically extendable to an operational position.

BACKGROUND OF THE INVENTION

Retractable antennas are desirable and widely used in portable cellular phones and other mobile telecommunication instruments to minimize overall size of the equipment, prevent accidental damage to the antenna when the instrument is not in actual use, and decrease the electromagnetic field strength to which a user of the instrument may be exposed. Typically, retractable antennas in portable telecommunication products, particularly portable telephones, are manually extended and retracted. Manually extending an antenna on a portable telephone is a "two-handed" operation and is, consequently, cumbersome and inconvenient, especially if the user is already holding something in his hands and is in hurry to receive an incoming call.

Powered extendable and retractable antennas are commonly used on vehicles, such as automobiles. However, these arrangements are not readily applicable to portable instrument applications because of the requirement for drive mechanisms which are relatively heavy, require considerable housing space, and reduce useful battery life.

Providing sufficient storage depth within the case for a retractable antenna is also a problem encountered with small portable telecommunication instruments. Usually there is minimal vertical clearance to allow retraction of the antenna, as the antenna length is typically about equal to or greater than the height of the instrument itself. This problem is more pronounced with the current tendency to make portable phones even smaller. In an attempt to overcome this problem, some phones use a flexible antenna that is curved within the case of the instrument when retracted, in order to provide sufficient length of the antenna when extended.

It is therefore desirable to have an antenna for a portable telecommunication instrument that is automatically self-extending upon release of a latch or other form of locking mechanism that maintains the antenna in a retracted position when the instrument is not being used. It is also desirable to have a retractable antenna assembly that does not require electrical power for extension of the antenna, is compact and lightweight, and has a simple construction that is inexpensive to manufacture.

SUMMARY OF THE INVENTION

In one aspect of the present invention, a retractable antenna assembly includes an antenna that is mounted in a body structure that is capable of supporting the antenna when the antenna is extended, and protectively enclosing the antenna when retracted. A guide member is positioned within the body structure and has a first portion adapted to receive the antenna when retracted and a second portion disposed in nonlinear relationship with the first portion. A compressible spring is positioned within the second guide member and provides a bias force against the antenna to urge the antenna to an extended position. The retractable antenna assembly also includes a means for selectively maintaining the antenna at a retracted position.

Other features of the retractable antenna assembly embodying the present invention include the guide member being alternatively defined by an internal passageway or channel within the body structure, or by a tubular member supported by the body structure.

DETAILED DESCRIPTION

Figure 1:
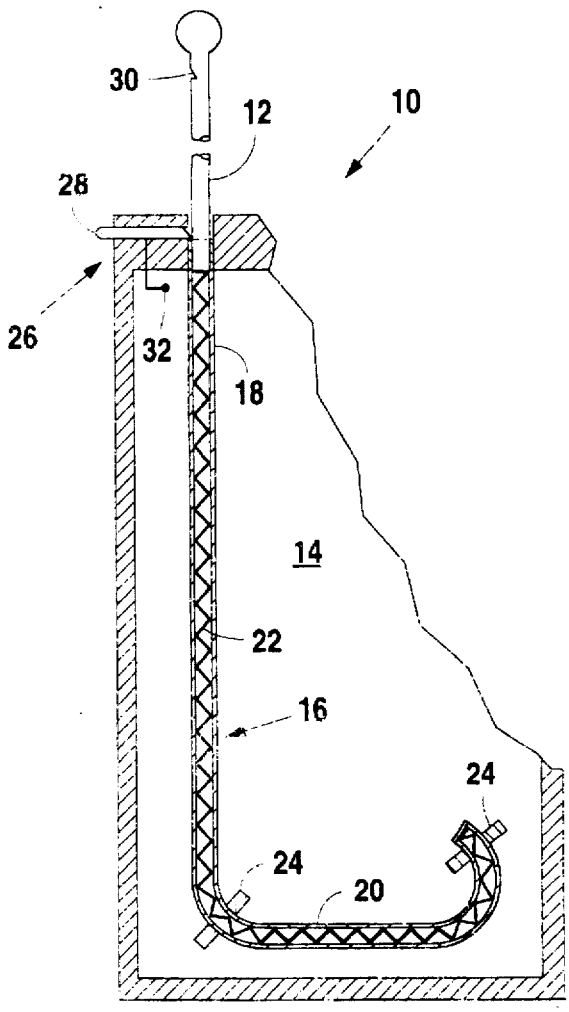
FIG. 1 is a schematic view of the retractable antenna assembly embodying the present invention, showing the antenna in an extended position.
Figure 2:
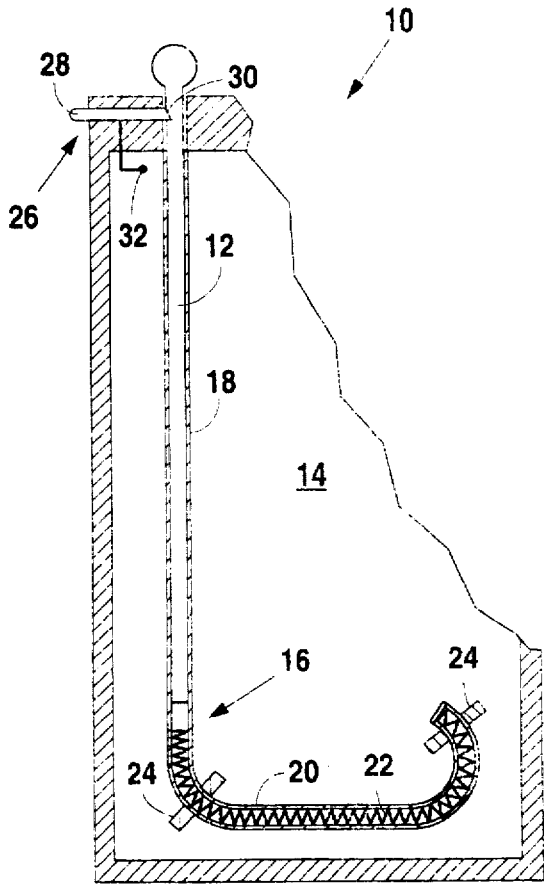
FIG. 2 is a schematic view of the retractable antenna assembly embodying the present invention, showing the antenna in a retracted position.

A retractable antenna system 10, embodying the present invention, has an antenna 12 that is shown in an extended position in FIG. 1, and in a retracted position within a body structure 14 in FIG. 2. Typically, the body structure 14 is the case or a portion of the frame of a mobile telecommunication instrument such as a portable or cellular telephone, and provides support for the antenna 12 when it is extended and a protective enclosure when retracted.

Importantly, the retractable antenna system 10 also includes a guide member 16 that, in the preferred embodiment, is a small diameter flexible tube formed of a low friction, electrically non-conductive plastic material such as polytetrafluoroethylene (PTFE) or nylon. The guide member 16 has a first portion 18 for receiving the antenna 12 when retracted, and a second portion 20 that provides an enclosure for a compressed spring 22. The spring 22 is in physical contact with the lower end of the antenna 12, and is compressed in response to retraction of the antenna 12. The second portion 20 of the guide member 16 is nonlinearly aligned with respect to the first portion 18 of the guide member 16, and may be routed inside the case 14 in any two-dimensional or compound three-dimensional path. However, if the antenna 12 is non-flexible, the first portion 18 of the guide member 16 should be linearly aligned in a straight path with the antenna 12, as illustrated in the drawings. Also, the bend radius of the second portion 20 of the guide member 16 should not be so sharp as to exceed the practical bend radius of the spring 22 or induce excessive friction between the spring 22 and the interior wall of the guide member 16 during extension and contraction.

The flexible guide member 16 is preferably held in a desired position within the case 14 by one or more retaining clips 24 which are integrally molded with the case 14. The retaining clips 24 have an opening that is slightly smaller than, and an inner diameter substantially the same as, the outer diameter of the guide tube 16, permitting the guide tube 16 to be snapped into place and then securely held by the clips 24.

Alternatively, the guide member 16 may be formed as an internal passageway or open C-shaped channel in the body structure 14. In whichever arrangement, either as a separate tube or internal passageway or channel, the guide member 16 can be routed to take advantage of any unused volume within the phone or instrument case, thereby requiring no additional volume, particularly in the vertical direction.

In an illustrative example, the spring 22 is formed of 0.008 in (0.2 mm) diameter steel wire having a shear modulus of about 120,000 psi (82,700 N/cm$^2$) and an outer coil diameter of 0.062 in (1.6 mm), providing a spring rate of 0.11 lb/in (19.3 N/m). A typical quarter-wave antenna of the type commonly used in portable telephones has an extended length of about 3.5 in (8.9 cm) and a weight of about 0.02 lb (9 g). It is desirable to have sufficient spring-applied bias force on the antenna 12 when fully extended to assure that it remains at the extended position, i.e., that the spring force applied to the antenna 12 when extended is greater than the weight, or mass, of the antenna 12. Thus, the spring 22 desirably has a free, or uncompressed, length that is greater than the length required to extend the antenna 12, for example a working, or expandable, length of about 4.0 in (10.2 cm), so that the spring 22 has an additional 0.5 in (1.3) of remaining compressed length when the antenna is fully extended. In the illustrative example, this remaining uncompressed length provides a bias force of 0.055 lb (0.24N) which is significantly greater than the above identified typical mass of the antenna 12.

By applying equations well known in the field of spring design, it can be shown that, in the above described illustrative example, the spring 22 has about 234 coils, resulting in a fully compressed, or essentially solid, length of about 1.87 in (4.75 cm), and a fully extended, or free, length of 5.87 in (14.9 cm). Thus, the guide member 16 has an overall length of about 6.0 in (15.2 cm) with a portion, e.g., about 0.1 in (0.25 mm), adjacent the end of the guide member 16 at the bottom of the second portion 20, sealed to provide a reaction surface for the distal end of the spring 22.

The retractable antenna assembly 10 embodying the present invention also includes a means 26 for selectively maintaining the antenna 12 in the retracted position shown in FIG. 2. In the preferred embodiment, the means 26 is a slidable latch 28 that has an end adapted to engage a detent 30 formed in the external surface of the antenna 12. When the antenna 12 is retracted, the latch 28 is moved to the right, as viewed in the drawings, whereupon it engages the detent 30, thereby locking the antenna 12 in its retracted position and preventing extension of the antenna 12 until moved away from engagement with the detent 30. Desirably, the latch 28 is biased by a spring, not shown, toward the detent 30 to prevent accidental disengagement and subsequent release and extension of the antenna 12. Also, by biasing the latch 28 toward the antenna 12, the latch 28 will be maintained in constant contact with the surface of the antenna and, when formed of an electrically conductive material, provide an electrical connection 32 suitable for transmitting signals between the antenna 12 and signal processing circuits of the instrument.

Alternatively, the means 26 for selectively maintaining the antenna 12 in the retracted position may be provided by other latching mechanisms such as metal or plastic springs, or may be mechanically connected to a flip-open cover on the instrument so that the antenna 12 automatically extends when the cover of the instrument is opened. Also, the entire retractable antenna assembly 12 may be fabricated as a "drop-in" assembly comprising one or more elements such as the antenna 12, the compression spring 22, the guide tube 16 if not otherwise provided in the body structure 14, the antenna retention latch 28, and electrical contacts or connectors 32.

In actual use, the antenna 12 is manually retracted by pushing the antenna into the first portion 18 of the guide member 16, whereupon the spring 22 is compressed into the second portion 20 of the guide member 16. The retention latch 28, or other arrangement of the latching mechanism 26, is then engaged to maintain the antenna 12 in the retracted position. Upon release of the latching mechanism 26, the antenna 12 extends automatically to the extended position whereat it is deployed and maintained during use of the instrument by the bias force provided by the spring 22.

Although the present invention is described in terms of a preferred exemplary embodiment, those skilled in the art will recognize that changes is guide member 16 construction and material, and other arrangements, diameters, spring rates and parameters of the compressible spring 22 may be made, consistent with the specifically stated operational requirement, without departing from the spirit of the invention. Likewise, the latching mechanism 26 may have a different construction and arrangement than that illustrated and described herein. Such changes are intended to fall within the scope of the following claims. Other aspects, features and advantages of the present invention can be obtained from a study of this disclosure and drawings, along with the appended claims.

What is claimed is:

1. A retractable antenna assembly, comprising:

an antenna having a lower portion and being movable between a fully extended position and a fully retracted position;

a body structure adapted for supporting said antenna when the antenna is at said extended position and protectively enclosing said antenna when the antenna is at said retracted position;

a guide member disposed within said body structure and having a first portion adapted to slidably receive at least a portion of said antenna therein and a second portion communicating with said first portion, said second portion being disposed in nonlinear relationship with said first portion;

a compressible spring disposed within said second portion of the guide member and arranged to provide a bias force against said lower portion of said antenna to urge the antenna to said fully extended position; and means for selectively maintaining said antenna at said fully retracted position.

2. A retractable antenna assembly, as set forth in claim 1, wherein said guide member is defined by an internal passageway integrally formed with said body structure.

3. A retractable antenna assembly, as set forth in claim 1, wherein said guide member comprises a flexible tubular member supported by said body structure.

4. A retractable antenna assembly, as set forth in claim 3, wherein said body structure includes an internal wall surface, and said flexible tubular member comprises a plastic tube supported at a predetermined position by the internal wall surface of the body structure.

5. A retractable antenna assembly, as set forth in claim 1, wherein the second portion of said guide member is disposed along a curvilinear pathway.

6. A retractable antenna assembly, as set forth in claim 1, wherein said antenna has an external surface and a detent formed in said external surface adjacent a distal end of the antenna, and said means for selectively maintaining said antenna at said retracted position includes a latch adapted to engage said detent in the external surface of the antenna.

7. A retractable antenna assembly, as set forth in claim 6, wherein said latch provides an electrical connection between said antenna and an electrical contact connectable with signal processing circuits of a telecommunication instrument.

* * * * *